United States Patent [19]

Ito

[11] 4,205,959

[45] Jun. 3, 1980

[54] IRRADIATED LIQUID FUEL, METHOD OF DECREASE OF PROPORTION IN NOXIOUS INGREDIENTS IN EXHAUST GAS AND METHOD OF REDUCTION OF FUEL CONSUMPTION

[75] Inventor: Yoshimatsu Ito, Tokyo, Japan

[73] Assignee: Michie Ito, Tokyo, Japan

[21] Appl. No.: 755,508

[22] Filed: Dec. 29, 1976

[51] Int. Cl.[2] ..... C10L 1/30

[52] U.S. Cl. ..... 44/50; 176/39

[58] Field of Search ..... 44/50; 176/39

[56] References Cited

U.S. PATENT DOCUMENTS

| | | | |
|---|---|---|---|
| 2,904,483 | 9/1959 | Long et al. | 176/39 |
| 2,976,422 | 3/1961 | Hill et al. | 176/39 |
| 3,065,159 | 11/1962 | Conner, Jr. et al. | 176/39 |

FOREIGN PATENT DOCUMENTS

| | | | |
|---|---|---|---|
| 48-88102 | 1/1973 | Japan | 44/50 |
| 575907 | 3/1946 | United Kingdom | 44/50 |

OTHER PUBLICATIONS

Ionizing Radiation and Life, Victor Arena, 1971, pp. 238–247.

Chem. Ab., vol. 80:124258m, 1974.

*Primary Examiner*—Winston A. Douglas
*Assistant Examiner*—Y. Harris-Smith
*Attorney, Agent, or Firm*—Holman & Stern

[57] ABSTRACT

The invention provides a liquid fuel irradiated with low radioactivity, method of decreasing the content proportion of noxious ingredients in the exhaust gas of an internal combustion engine, and a method of reduction of fuel consumption by irradiation of liquid fuel with low radioactivity. The irradiated liquid fuel reduces the content proportion of noxious ingredients in the exhaust gas, increases and raises combustion efficiency, pushes the power up, and reduces fuel consumption.

7 Claims, No Drawings

IRRADIATED LIQUID FUEL, METHOD OF DECREASE OF PROPORTION IN NOXIOUS INGREDIENTS IN EXHAUST GAS AND METHOD OF REDUCTION OF FUEL CONSUMPTION

BACKGROUND OF THE INVENTION

This invention relates to liquid fuel, a method of decreasing the content proportion of noxious ingredients in exhaust gas and a method of reduction of fuel consumption, more particuarly, relates to liquid fuel irradiated with low radioactivity for an internal combustion engine, and a method of decreasing the content proportion of noxious ingredients in exhaust gas of internal combustion engine by using liquid fuel irradiated with low radioactivity, and a method of reduction of fuel consumption of liquid fuel by using liquid fuel irradiated with low radioactivity.

There is a limit to oil resources and its deposits underground, and it has been shown by a recent calculation that the remaining oil resources may be exhausted in about sixty years, if the present rate of demand for the oil resources is continued. It is well known that the problems of reduction of demand for the oil resources are discussed and developed for all over the world conjointly with the spread of motorcar and the growth of petrochemical industry.

Moreover, the spread of motorcar causes environmental pollution as air pollution by exhaust gas of the motorcar. Measures are being taken against environmental pollution as problems of human existence and of injury to human health. These social problems have grown along with the oil resources problems.

For solution of these problems, each automobile maker is developing several internal combustion engines of motorcars with a low pollutant level exhaust and with low fuel consumption, and such makers are studying also their creative systems of the internal combustion engines, as it is well known. However, the problems faced and found through study are in antinomic results for exhaust of the noxious ingredients "CO" and "HC," and "NOx" in relation between combustion efficiency and exhaust gas. Namely "CO" and "HC" in the noxious ingredients decrease, while "NOx" increases when temperature of combustion gas in cylinder is raised in order to promote the combustion efficiency, and on the other hand, when the temperature of combustion gas is reduced in order to decrease "NOx," "CO" and "HC" increase in inverse proportion to "NOx."

The systems being developed to solve the above problems are classified roughly as follows:

(1) Catalyst converter systems changing "CO" and "HC" in the exhaust gas produced in a cylinder to "$CO_2$" and "$H_2O$" by chemical action which occurs in the catalyst converter installed in the exhaust system.

(2) Thermal reactor systems reburning "CO" and "HC" of the first exhaust gas by the thermal reactor after decreasing "NOx" by a exhaust gas circulation device.

(3) Subcombustor systems preburning heavy mixture gas in the subcombustor, and continually burning rarefied mixture gas in the main combustor by the flame and heat of heavy mixture gas. These systems have not realized yet effects expected for decrease of the noxious ingredients in the exhaust gas, because they aim at only the peculiar construction of the internal reciprocating engine thus adding high cost expenses to the manufacture and use of the same.

SUMMARY OF THE INVENTION

This invention stands on the foundation of a concept substantially different from the above conventional concepts of a system for the construction of internal combustion engine improvements by the automobile makers and others. The conventional concepts have not yet directed attention to the liquid fuel for the internal combustion engine, to the contrary, the present invention is directed to the liquid fuel for the internal combustion engine, not the construction of the engine. The present invention is directed to the liquid fuel which is irradiated with radioactivity sufficiently low so as not to adversely affect human beings, animals, plants and others. Also, the invention is directed to the liquid fuel so as to push the power up and increase combustion efficiency of the fuel and decrease simultaneously the noxious ingredients in the exhaust gas. In addition, the present invention reduces the consumption of fuel of the internal combustion engine and saves expense of the fuel therefor. Further, the present invention is directed as a measure taken against environmental pollution.

Accordingly, an object of the present invention is to provide a liquid fuel irradiated with radioactivity sufficiently low so as not to adversely affect human beings, animal, plants and others.

Another object of the present invention is to provide a method of decreasing the content proportion of noxious ingredients in the exhaust gas from internal combustion engines, and to reduce the exhaust gas therefrom.

A further object of the present invention is to provide a method of increasing the combustion efficiency of the liquid fuel which has been irradiated with low radioactivity, thus reducing the exhaust gas therefrom.

Other objects and many of the attendant advantages of this invention will be readilly appreciated as the same becomes better understood by reference to the following description.

THE DETAILED DESCRIPTION OF THE INVENTION

As the means for irradiation of the liquid fuel for internal engines, Monazite, an ore is in use, which is produced in the region of Ina, Nagano-ken, Japan, and emits natural low radioactivity. The Monazite is particulately broken into pieces having a diameter of 3 to 5 mm, and is washed off to remove splinters and dirt. The Monazite is soaked in the fuel in a tank or the like for irradiation in which the liquid fuel is irradiated. The Monazite is removed after enough time, and the soaked and irradiated liquid fuel is used as the fuel for internal combustion engines. Other hand, it can be possible to apply in an another way in which the Monazite is continually spread and contained in the tank and the liquid fuel filled up will be removed after enought time for irradiation, too.

In any way, it is enough to apply irradiation of the natural low radioactivity to the liquid fuel by means of soaking for enough time. However, the means for irradiation are not limited to the above-disclosed ways of soaking the Monazite in the liquid fuel, and any other means and ways for irradiation of the natural low radioactivity to liquid fuel can be adopted.

The components, properties and proportion in the Monazite are "$Ce_2O_3$: 39 to 74%", "$ThO_2$: 1 to 18%", "$ZnO_2$: 1 to 7%" and "$Y_2O_3$: 1 to 5%" containing $(CeY)PO_4$ and $ThSiO_4$, and there are sometimes substituted components of some rare-earth metals in Cerium group and in Yttrium group for said Cerium and Yttrium. The Monazite is flat, long and slender, or plug shaped of Monoclinic system, or has granular texture when found as a placer, and has a hardness of 5 to 5.5, and has a specific gravity of 4.9 to 5.3 sp. gr. Monazite has a resinous luster, and is generally yellowish brown or reddish brown in color.

Table I shows the numerical value in the results of a measurement examination of the radioactivity and Gamma ray energy. For the measurement of the radioactivity in the Monazite, the 2 inch Nal(T1) Scintillation counter was used, and for measuring and analyzing of the Gamma Ray Energy, 2 inch Nal(T1) Scintillation Head and 256 Channels Wave High Analysis Apparatus were used.

TABLE I (1) Quantity of radioactivity on the surface: 4429 ± 23 CPM
(2) Analysis of the Gamma Ray Energy:
0.24 Mev 0.29 Mev 0.35 Mev 0.62 Mev
212pb(ThB) 214pb(RaB) 214pb(RaB) 214Bi
224Ra(ThX) 212pb(ThB)
214pb(RaB)

From this examination, it can be realized the Thorium 232Th and nuclides in disintegration system are formed in the Monazite ore.

EXAMPLE I

The Monazite ore produced in the region of Ina, Nagano-ken, Japan, is broken into pieces having a diameter of 3 to 5 mm, which the pieces are washed off removing the splinters and dirt. The washed Monazite pieces in the proportion of 50 g per one liter of the regular gasoline are soaked in the gasoline for five hours. The non-irradiated regular gasoline is hereinafter referred to as "the Gasoline A." Some of said "Gasoline A," irradiated by the natural low radioactivity of the Monazite is hereinafter referred to as "the Gasoline B."

The results of the tests for the fuel consumption in comparison with the above two Gasoline A and B are shown in the Table II. The tests have been taken by JAPAN VEHICLE INSPECTION ASSOCIATION.

Motorcar:
Kind and model: "Boulevard" P610
Chassis No. P610-030390
Engine type: L18
Dead weight: 1,000 Kg.
Gross weight: 1,275 Kg.
Displacement aggregate: 1,770 cc
Highest capacity: 105 ps at 6,000 rpm
Inertia capacity converted from engine shaft: 1,250 Kg.
Maximum proportion of reduction speed: 3.700
Effective semidiameter of tire: 292 mm
Total distance covered: 49,829 Km.
"CO" concentration at idling time: 2.3%
(The motorcar had installed therein an ignition timing automatic control device.)
Automatic counter of fuel consumption:
Model No. DFM-140 Xs manufactured by Ono Measuring Instrument Co. Ltd.
Test date: Aug. 18, 1975
Atmospheric temperature: 27° C.
Humidity: 56%
Time and conditions at the start of the test:
Time: 30 minutes past 14 p.m.
Atmospheric pressure: 751 mmHg
Temperature of cooling water: 80° C.
Temperature of lubricating oil: 80° C.
Time and conditions at the end of the test:
Time: 35 minutes past 15 p.m.
Atmospheric pressure: 751 mmHg
Temperature of cooling water: 80° C.
Temperature of lubricating oil: 81° C.
Revolution of engine: 600 rpm
"CO" concentration: 2.3%
Ignition timing control angle: 10°

As it is understood from the above disclosed results of the fuel consumption test, consumption of fuel has been reduced about 7.4% by the Gasoline B compared with the Gasoline A at speed of 40 KM per one hour, and about 4.8% at speed of 60 KM per one hour, and about 3.8% at speed of 80 KM per one hour. Therefore, the consumption fuel was reduced about 6% on an average at the economical speed of 40 to 60 KM per one hour.

The results of the test for exhaust gas in comparison with the above two Gasoline A and B are shown in the Table III and IV.

TABLE II

| Speed of motorcar KM/h | Kind of fuel | Revolution of engine rpM | Inhalation pressure mmHg | Consumed fuel ml | Distance covered KM | Time required S | Real speed KM/h | Proportion for fuel consumption KM/l | Percentage of fuel consumption % |
|---|---|---|---|---|---|---|---|---|---|
| 40 | A | 1,500 | 420 | 218 | 3 | 258.4 | 41.80 | 13.76 | — |
| | B | 1,500 | 420 | 203 | 3 | 258.8 | 41.73 | 14.78 | 7.4 |
| 60 | A | 2,100 | 400 | 218 | 3 | 174.0 | 60.07 | 13.76 | — |
| | B | 2,100 | 410 | 208 | 3 | 174.5 | 61.89 | 14.42 | 4.8 |
| 80 | A | 2,800 | 400 | 222 | 3 | 133.5 | 80.90 | 13.51 | — |
| | B | 2,800 | 400 | 214 | 3 | 134.4 | 80.36 | 14.02 | 3.8 |

Test conditions

TABLE III

| | Results by the Gasoline A | | | |
|---|---|---|---|---|
| Components | Diluted exhaust gas concentration A | Environmental concentration B | Actual concentration A − B × (1-1/DF) | Weight of exhaust components per 1 KM |
| CO | 0.038% | — | 0.038% | 7.23 g |
| HC | 277.5 ppMC | 4.0 ppMC | 273.7 ppMC | 2.57 g |
| NOx | 40.3 ppM | 0.2 ppM | 40.2 ppM | 1.52 g |
| $CO_2$ | 0.67% | 0.05% | 0.62% | 184.5 g |

TABLE IV

| Components | Diluted exhaust gas concentration A | Results by the Gasoline B: Environmental concentration B | Actual concentration A − B × (1-1/DF) | Weight of exhaust components per 1 KM |
|---|---|---|---|---|
| CO | 0.036% | — | 0.036% | 6.86 g |
| HC | 271 ppMC | 4.0 ppMC | 267.2 ppMC | 2.51 g |
| NOx | 41.8 ppM | 0.2 ppM | 41.6 ppM | 1.29 g |
| $CO_2$ | 0.68% | 0.05% | 0.63% | 187.7 g |

Test conditions
Motorcar:
Kind and model: "Datsun" 610
Chassis No. 610-063709
Engine type: L16
Dead weight of car: 960 Kg.
Gross weight: 1,235 Kg.
Displacement aggregate: 1,595 cc
Highest capacity: 100 ps at 6,000 rpm
Inertia capacity converted from engine shaft: 1,000 Kg.
Maximum proportion of reduction speed: 3.900
Effective semidiameter of tire: 292 mm
Total distance covered: 32,500 Km.
"CO" concentration at idling time: 0.52%
Gas analysis device:
Name and model: MEXA-2200

| Gas | System | Measurement range |
|---|---|---|
| CO | NDIR | 0-0.3%, 0-1.0%, 0-3%, 0-10% |
| $CO_2$ | NDIR | 0-5%, 0-16% |
| HC | FID | 0-50 ppm × 1, 2, 5, 10, 20, 50, 100, 200, 500 |
| NOx | CLD | 0-10 ppm × 1, 2, 5, 10, 20, 50, 100, 200, 500 |

Test date: Oct. 27, 1975
Atmospheric temperature: 20° C.
Atmospheric pressure: 768 mmHg
Humidity: 63.7%
Testing time:
For the Gasoline A: From 15 minutes past 10 a.m. to 45 minutes past 10 a.m.
For the Gasoline B: From just 11 a.m. to 30 minutes past 11 a.m.

As it can be understood from the results of the above tests for the exhaust gas that the content proportion in noxious ingredients are reduced by the Gasoline B in comparison with the Gasoline A. Specifically with Gasoline B, namely, the proportion of "CO" was reduced about 5% because the weight of "CO" by the Gasoline A is 7.23 g, while, the weight of "CO" by the Gasoline B is 6.86 g, and the proportion of "HC" was reduced about 2% because the weight of "HC" by the Gasoline A is 2.57 g, while, the weight of "HC" by the Gasoline B is 2.51 g, and also proportion of "NOx" was reduced about 15% because the weight of "NOx" by the Gasoline A is 1.52 g, while, the weight of "NOx" by the Gasoline B is 1.2 g.

In addition, it must be specially mentioned one of the most important and deserving features that it could be settled the above stated antinomic relation between the problems of increase and decrease with regard to the noxious ingredients "CO," "HC" and "HOx," when the irradiated Gasoline B is used for an internal combustion engine.

EXAMPLE II

The Monazite pieces stated in the above Example I in a proportion of 50 g per one liter of the light oil is soaked in the light oil in a container for four hours. The non-irradiated light oil is hereinafter referred to as "the Light Oil C". Some of this "Light Oil C," irradiated by the natural low radioactivity of the Monazite is hereinafter referred to as "the Light Oil D."

The results of the tests for the liquid fuel consumption with regard to the above two Light Oil C and D are shown in the Table V. The test car is "Isuzu Diesel Car" of model 1966 with an installed diesel engine of 2,000 cc for displacement aggregate.

TABLE V

| Kind of fuel | Weather conditions | Road | Distance covered | Consumed fuel | Proportion for consumed fuel |
|---|---|---|---|---|---|
| Light Oil C | Cloudy to rain | General | 625 Km | 56 1 | 11.2 KM/l |
| Light Oil D | Cloudy to rain | " | 471 Km | 39 1 | 12.1 KM/l |

As it can be understood from the above disclosed results of the fuel consumption test that the consumption of fuel was reduced about 10% by the Light Oil D when compared with the Light Oil C.

It can be seen from physical observation that by the soaking treatment of the natural low radioactive Monazite pieces in the liquid fuel, moisture in said fuel adheres to or is absorbed by the disintegrated pieces through the function of ionization, being accompanied by disintegration of the Monazite. Accordingly, the cloud point of the fuel becomes better or is materially ameliorated so that the combustion efficiency of the treated liquid fuel rises.

Also, it can be seen that Radon generates from the radioactive substances in the Monazite, so successively, such Radon converts into Helium. And a complex chemical action is caused in the liquid fuel when the radioactive Monazite substance is soaked in and irradiates the liquid fuel. Moreover, it can be seen also that generated Helium gas in the liquid fuel at irradiating time covers on the combustion portion in the internal engine, and the phenomenon causes the internal engine to restrain abnormal rising of the combustion temperature. Then the restraint of combustion temperature causes the noxious ingredient, "NOx" to decrease. Therefore, in accordance with the synergism of the amelioration and the chemical action, combustion efficiency of irradiated liquid fuel rises and concurrently the noxious ingredients in the exhause gas decrease.

Further, any other method and way for irradiation with low radioactivity can be used on the Gasoline A and the Light Oil C in addition to the above soaking method. For example as another way, Monazite pieces broken and washed can be spread by making use of a net on the inner surface of the wall and the bottom of the large fuel tank or Monazite pieces can be spread on the inner surface of the bottom or around the sides of the fuel tank of motorcar. And in addition to soaking method, any other method for irradiation with low radioactivity to the liquid fuel can be adopted. Also, in lieu of radioactive Monazite, other radioactive pegmatite or the mineral of an ore containing the rarefied elements similar with the Monazite can be substantially adopted in a similar manner. Moreover, it can be well understood, of course, that in addition to the present invention for liquid fuel, even more of the above stated substantial effects with regard to combustion efficiency and prevention of environmental pollution by the exhaust gas can be actually expected when the mechanical improvements of the internal combustion engine will be effective.

Consequently, as shown in the above indicated test data, the present invention is effective as measures taken to prevent environmental pollution and as measures taken for economy and saving liquid fuel by means of using the liquid fuel irradiated with low radioactivity.

The invention may be embodied in other specific forms without departing from its spirit or essential characteristics. The described invention is to be considered in all respects only as illustrative and not restrictive and the scope of the invention is, therefore, indicated by the appendant claims rather than by the foregoing description. All changes which come within the meaning and ranges of equivalency of the claims are to be amended within their scope.

What is claimed is:

1. A method of preparing an improved liquid fuel for use in an internal combustion engine comprising soaking mined radioactive Monazite pieces emitting a low level of radioactivity, each of said pieces having a diameter of about from 3 mm to 5 mm, in a liquid motor fuel until the latter has been irradiated to a low level of radioactivity.

2. A method of preparing an improved liquid fuel for use in an internal combustion engine comprising soaking a natural radioactive substance emitting a low level of radioactivity in a liquid motor fuel until the latter has been irradiated to a low level of radioactivity.

3. The method of claim 2 wherein the natural radioactive substance is Monazite.

4. The method of claim 3 wherein the liquid motor fuel is gasoline.

5. The method of claim 4 wherein the irradiation is accomplished by soaking radioactive Monazite pieces for about five hours in the gasoline in the proportion of 50 g. per liter of the gasoline.

6. The method of claim 3 wherein the liquid motor fuel is light oil.

7. The method of claim 6 wherein the irradiation is accomplished by soaking radioactive Monazite pieces for about four hours in the light oil in the proportion of 50 g. per liter of the light oil.

* * * * *